US006966582B1

(12) United States Patent
Malone et al.

(10) Patent No.: US 6,966,582 B1
(45) Date of Patent: Nov. 22, 2005

(54) LOCK ROD CLUTCH FOR OVEN LATCH

(75) Inventors: Charles F. Malone, Smithville, TN (US); James D. Livers, Jr., Cookeville, TN (US)

(73) Assignee: France/Scott Fetzer Company, Fairview, TN (US)

( * ) Notice: Subject to any disclaimer, the term of this patent is extended or adjusted under 35 U.S.C. 154(b) by 317 days.

(21) Appl. No.: 10/002,049

(22) Filed: Nov. 2, 2001

(51) Int. Cl.[7] ..... E05C 19/10

(52) U.S. Cl. ..... 292/95; 292/64; 292/109; 292/110; 292/DIG. 66; 292/DIG. 69

(58) Field of Search ..... 292/109, 110, 64, 292/DIG. 66, DIG. 69; 70/DIG. 10; 126/191, 126/197

(56) References Cited

U.S. PATENT DOCUMENTS

| | | | | |
|---|---|---|---|---|
| 3,438,666 A | | 4/1969 | Erickson | |
| 3,540,767 A | * | 11/1970 | Siegel | 292/210 |
| 3,894,214 A | * | 7/1975 | Staples | 219/394 |
| 4,039,993 A | * | 8/1977 | Kerr | 337/366 |
| 4,133,337 A | | 1/1979 | Shea | |
| 4,718,705 A | * | 1/1988 | Case | 292/201 |
| 4,838,586 A | | 6/1989 | Henne | |
| 4,862,870 A | * | 9/1989 | Fox | 126/197 |
| 5,004,276 A | | 4/1991 | Hanley | |
| 5,012,794 A | | 5/1991 | Faurel | |
| 5,029,910 A | | 7/1991 | Genbauffe et al. | |
| 5,062,668 A | | 11/1991 | Onderka et al. | |
| 5,072,974 A | | 12/1991 | Henne | |
| 5,121,950 A | | 6/1992 | Davidian | |
| 5,220,153 A | | 6/1993 | Malone et al. | |
| 5,419,305 A | | 5/1995 | Hanley | |
| 5,440,103 A | | 8/1995 | Martin | |
| 5,456,243 A | | 10/1995 | Jones | |
| 5,477,030 A | | 12/1995 | Buckshaw et al. | |
| 5,493,099 A | | 2/1996 | McWilliams, III | |
| 5,676,408 A | | 10/1997 | Davidian | |
| 5,746,005 A | | 5/1998 | Steinberg | |
| 5,746,456 A | | 5/1998 | Violi et al. | |
| 6,474,702 B1 | * | 11/2002 | Malone et al. | 292/97 |

* cited by examiner

*Primary Examiner*—Daniel P. Stodola
*Assistant Examiner*—Carlos Lugo
(74) *Attorney, Agent, or Firm*—Wood, Herron & Evans, L.L.P.

(57) ABSTRACT

An oven door lock for self-cleaning ovens is described. The oven door lock includes a clutch mechanism which locks and unlocks the oven door at substantially different temperatures, in particular, the lock temperature is substantially higher than the unlock temperature. The clutch mechanism comprises a thermally responsive element, a clutch, and a lock member. During heating, in a self-clean or normal cooking operation, an expanding thermally responsive element, acting upon the clutch, causes the lock member to lock the oven door. During cool down, the contracting thermally responsive element, acting upon the clutch in an opposing direction, in concert with a restraining spring, causes the lock member to unlock the oven door at a temperature substantially lower than the locking temperature.

11 Claims, 6 Drawing Sheets

LOCK ROD CLUTCH FOR OVEN LATCH

FIELD OF THE INVENTION

The present invention relates to door latches for ranges, ovens and like appliances, and more particularly, to a latch assembly for use in self-cleaning ovens.

BACKGROUND OF THE INVENTION

Modern ovens are often equipped with the capability to self clean. Self-cleaning is accomplished by heating the oven to temperatures of approximately 400°–480° C. (750°–900° F.) Typically, an oven can be placed in a self cleaning mode only when the oven door is it its latched state and often a lock is provided to lock the oven in its latched state while self cleaning. Generally, most non-self cleaning or normal baking occurs at temperatures at or below 500° F. while the oven door is in either a latched or an unlatched state. Therefore the prior art has included an oven door locking mechanism, effective when the oven door is latched, which locks the oven door at a temperature around approximately 500° F.

Prior art oven door locking mechanisms take various forms. Some are manual locking devices while others are automatic or motor driven locking devices. Manual devices have been developed to include thermostatically controlled locking mechanisms to prevent the inadvertent opening of the oven door at elevated temperatures during operation. In some self cleaning ovens, the locking device uses a bimetallic coil to thermally respond to changing temperatures to effect the locked and unlocked states. Such devices are disclosed in U.S. Pat. Nos. 3,438,666; 4,133,337 and 4,838,586. However, these mechanisms are problematic as they may lock at a temperature consistent with normal baking, or unlock, allowing the oven door to be opened, while the oven cavity is dangerously hot. Such devices, if unlocked while cleaning, may pose a safety risk to persons opening the oven door. Furthermore, in a normal baking mode, if such an oven door becomes locked, it prevents the inspection of or addition to the baking foods thus leading to the possibility of overcooked or even burnt foods.

U.S. Pat. No. 5,456,243 teaches a manual oven locking device which locks and unlocks the oven door by counterbalancing springs. However, the control of temperature is limited as the spring must be changed to alter the temperature at which the oven locks or unlocks.

Hence, a problem exists in that during an extended baking cycle or a self cleaning mode, the latched oven door may become locked at 'too low' a temperature presenting a potential baking catastrophe or may be opened at 'too high' a temperature presenting a potential safety hazard.

OBJECTIVES OF THE PRESENT INVENTION

The present invention is intended to eliminate the problem of the prior art by providing a locking mechanism capable of locking and unlocking at substantially different temperatures. Specifically, the present invention allows the latched oven door to lock at a temperature substantially higher than that at which it unlocks.

Accordingly, it is an object of the present invention to provide an improved oven door lock having a method to control the locking and unlocking temperatures of the oven door during operation.

It is another object of the present invention to provide an oven door lock whose locking temperature is substantially higher than its unlocking temperature.

It is yet another object of the present invention to provide an oven door lock which prevents the oven door from locking in a latched state during non self-cleaning operation.

Yet another objective of the present invention is to provide an improved oven door locking mechanism with a refined degree of cool down temperature control to unlock the oven door.

SUMMARY OF THE INVENTION

The invention, for use in a self-cleaning oven, may be embodied in an improved oven door locking mechanism capable of locking a closed, latched oven door at a temperature substantially higher than that at which it unlocks. The door locking mechanism generally includes a clutch mechanism, a latch mechanism defining a lock hole therein and a first spring contacting a lock member. The clutch mechanism comprises a thermally responsive element, a clutch, and the lock member. The thermally responsive element is in engagement via the clutch with the lock member to cause the desired ascent and descent of the lock member i.e., locking and unlocking the latched oven door during self-cleaning.

In the illustrated embodiment, the thermally responsive element generally has a first end and a second end. The first end is secured to the door locking mechanism and the second end defines a second side of the clutch, in the form of a slot which is in engagement with a first end of the lock member. In the described embodiment, the slot is elongated in shape, and the thermally responsive element is a bimetallic leaf whose slot is slidably and inseparably engaged with the lock member.

In this illustrated embodiment, the lock member, which may be a cylindrical lock rod, comprises a first end and a second end. The first end defines a first side of the clutch, in the form of a keyed aperture. The keyed aperture is in engagement with the slot, in the thermally responsive element, defining the second side of the clutch. The keyed aperture comprises an annular recess, along the axial surface, as a groove whose length is determined by the desired difference between the locking and unlocking temperatures of the oven door. The length of this groove is traversed by the expanding and contracting bimetallic leaf during heating and cooling of the oven, and thus this length determines the difference between the temperatures at which the oven door locks and unlocks. The second end of the lock member is adapted to be received by the lock hole defined in the latch mechanism.

In the described embodiment, the oven door may be locked or unlocked only in a latched state. Specifically, the latch mechanism comprises a lock hole to enable a latched-locked state for the oven door. When the closed oven door is latched, the lock hole moves into a position to receive the second end on the lock member. In an alternate embodiment, the lock hole is fitted with a receiver member adapted to receive a lock member therein. The receiver member may be, but is not limited to, a zinc plated steel bushing which withstands the high self-cleaning oven temperatures and is resistant to rust.

Additionally, the described door locking mechanism includes a first spring contacting the lock member. The first spring may be any material resistant to high oven temperatures, such as either stainless steel or an alloy composition known in the art as 'Inconel', and any shape, such as a hairpin. The first spring, affixed to a mounting bracket, encompasses the lock member, exerting force upon it to prevent the locked oven door from achieving an unlocked state during cool down until a predetermined cool down temperature has been reached.

When self-cleaning cycle is complete or when the oven is turned off after cooking or baking is finished, the oven cavity will cool down. During cool down, as the temperature decreases, the bimetallic leaf contracts and retracts. During retraction, the bimetallic leaf traverses the length of the annular recess. During traversal, the lock rod remains it its locked state or in the lock hole against the force of gravity due to the frictional force exerted upon it by the spring. After the bimetallic leaf traverses the recess, the bimetallic leaf begins to pull the lock rod in the direction of retraction. The retractive force overcomes the frictional force exerted by the first spring and causes the lock rod to release from the lock hole, thus unlocking the oven door. The length or distance of the traversed annular recess coupled with the retraction characteristics of the bimetal and the frictional force of the first spring will allow a reduced temperature, substantially lower than that at which the oven locks, at which the lock rod is released, to unlock the oven door.

In a preferred embodiment, the bimetallic leaf is chosen based upon the individual expansion and contraction characteristics of the metals to match the desired lock and unlock temperatures of the oven door. However, because of the difference between the lock and the unlock temperatures facilitated by the principles of the present invention, the bimetallic leaf may not need to be calibrated to the oven chamber, or calibrated as accurately as the thermally responsive elements of the prior art.

In a preferred embodiment, latch mechanism includes an improved nuisance latch which prevents the latch mechanism from being moved from the unlatched state to the latched state at an elevated temperature and, therefore, avoiding inadvertent locking of the latch mechanism in the latched state, during non-self-cleaning, elevated temperature operation of the oven. The nuisance latch includes a second thermally responsive element which deflects into engagement with the latch mechanism as the oven is used for cooking. Once the second thermally responsive element engages the latch mechanism, the lock hole is no longer accessible to the lock rod upon deflection by the expanding bimetallic leaf. Thus, the lock member is prevented from locking the latch mechanism in the latched state.

Other objects and advantages and a full understanding of the invention will be had from the following detailed description of the preferred embodiments and the accompanying drawings.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

Preferred embodiments of the invention are shown in the accompanying drawings in which.

DETAILED DESCRIPTION OF SPECIFIC EMBODIMENTS

The detailed description describes the common features of our pending U.S. Pat. No. 639,588, which is hereby incorporated by reference herein, as well as the present invention disclosed.

Figure 1:
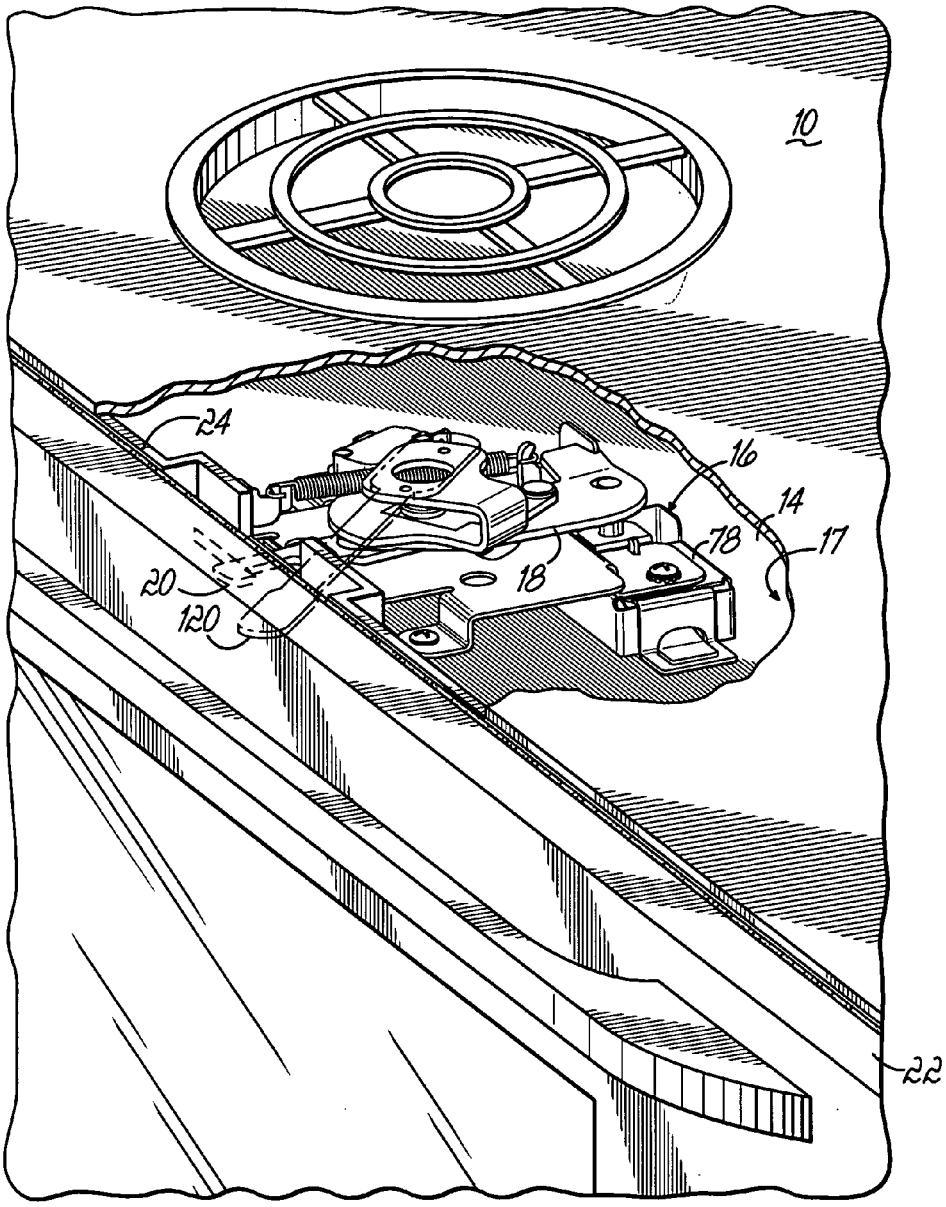
FIG. 1 is a partial cut away view of an oven having an oven door lock embodying principles of the present invention.

Referring to FIG. 1, a cooking apparatus is generally designated by the reference numeral 10. The cooking apparatus 10 includes a cooking chamber wall 14, and a door lock 16 embodying the present invention. During a self-cleaning operation of the cooking apparatus 10, the door lock 16, which includes a latch mechanism 18 with a latch arm 20, is manually operated to latch door 22 to frame 24. The latch mechanism 18 is manually operated to release the door 22 after the self-cleaning operation is completed and the temperature of the cooking chamber 17 has fallen to a predetermined temperature.

Figure 1A:
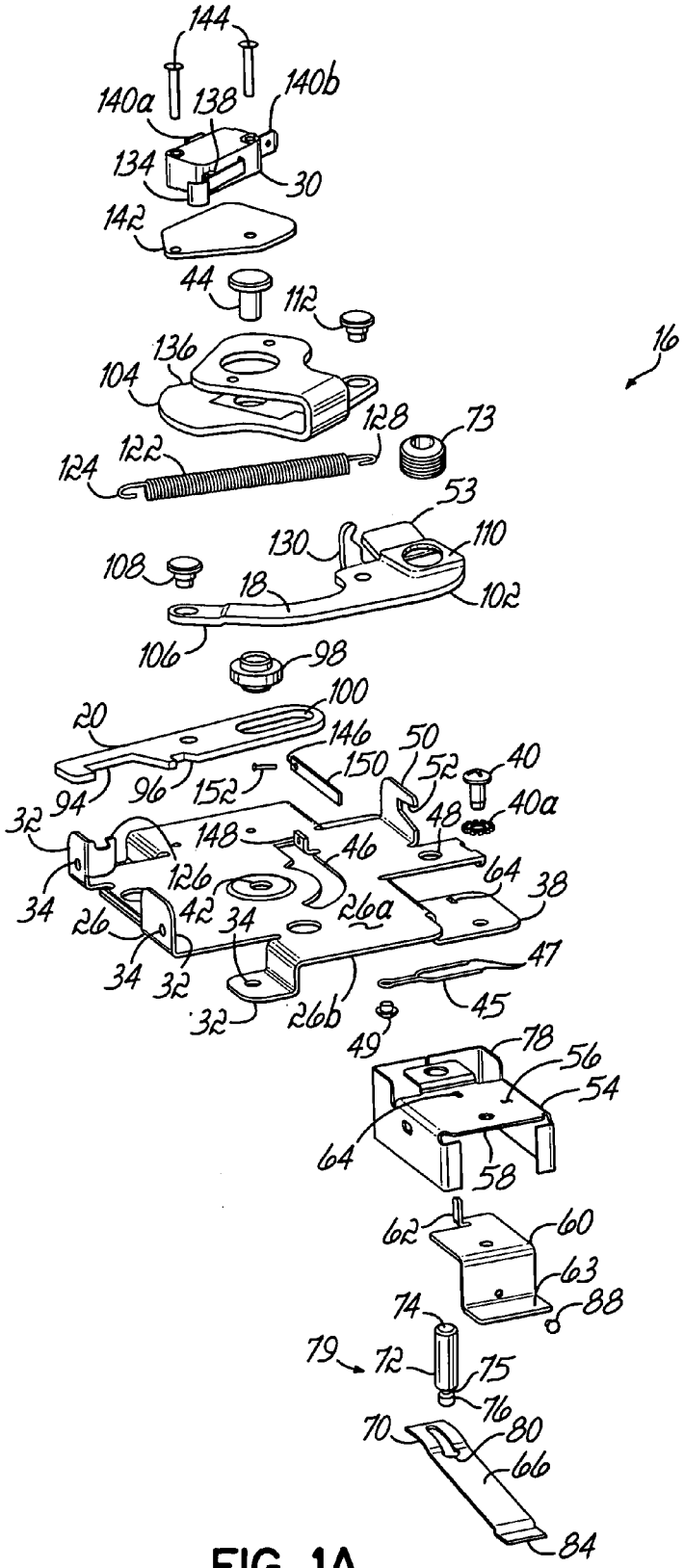
FIG. 1A is an exploded view of the oven door lock of FIG. 1.

The door lock 16 is fixed to the frame 24 in a position near the front and center of the cooking apparatus 10 and just above the cooking chamber wall 14 as illustrated in FIG. 1. As seen in FIGS. 1A and 3, the door lock 16 generally includes a mounting bracket 26, the latch mechanism 18, a lock mechanism 78, and a switch 30. The latch mechanism 18 is pivotally affixed to the mounting bracket 26 and biased in one of the latched (FIG. 2) or unlatched (FIG. 2A) states, as discussed further below. The switch 30 indicates whether the latch mechanism 18 is in either the unlatched or latched state.

Figure 5:
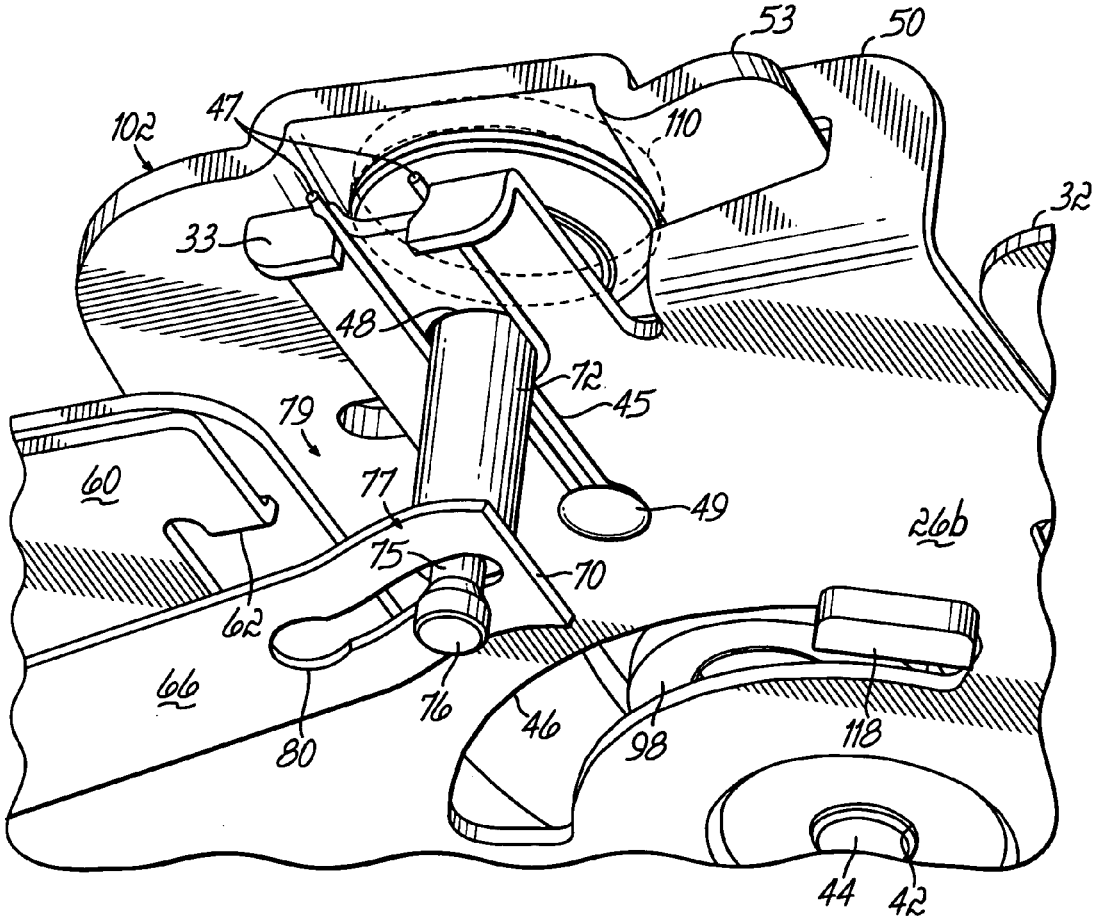
FIG. 5 is an enlarged view of the oven door lock as shown in FIG. 2.

As seen in FIG. 1A, the mounting bracket 26 has upwardly and downwardly depending mounting flanges 32 which define holes 34 through which screws 36 (FIG. 3) or any other suitable means are used to affix the mounting bracket 26 to the cooking chamber wall 14 (FIG. 1). The mounting bracket 26 also has a lock flange 38 to which the lock mechanism 78 is separably attached with screw 40 and lock washer 40*a* or any other suitable means. The mounting bracket 26 defines a generally centrally located pivot hole 42 through which a latch pin 44 is received which secures the latch mechanism 18 to a first surface 26*a* of the mounting bracket 26. Mounting bracket 26 also includes a first spring 45 whose first end is affixed to a second surface 26*b* of the mounting bracket 26 by means of a rivet 49 or by any other suitable means and two second ends 47 are resiliently received by a second flange 33 on the mounting bracket 26. The first spring 45, as shown in greater detail in FIG. 5, is positioned to encompass a lock member 72 of the lock mechanism 78 and exert restraining pressure on the lock member 72. First spring 45 may be a hairpin clip or any other conventional spring. The mounting bracket also defines a guide hole 48 capable of substantially and coaxially aligning with a lock hole defined in the link arm 102 of the latch mechanism 18. Adjacent the pivot hole 42 is an arcuate slot 46 which limits the movement of the latch mechanism 18, as discussed further below.

FIG. 1A also reveals the lock mechanism 78 as having a cover 54 with an outer surface 56 received against a second surface 26*b* of the mounting bracket 26 and is separably attached to the lock flange 38 by screw 40 and lock washer 40*a* or any other suitable means. The cover 54 has an inside surface 58 to which a mounting foot 60 is affixed by screw 40. The mounting foot 60 has an upwardly depending finger 62 received through a slot 64 in the mounting bracket 26 to stabilize the lock mechanism 78 in position against the mounting bracket 26. Mounting foot 60 also has a downwardly depending flange 63.

Figure 2:
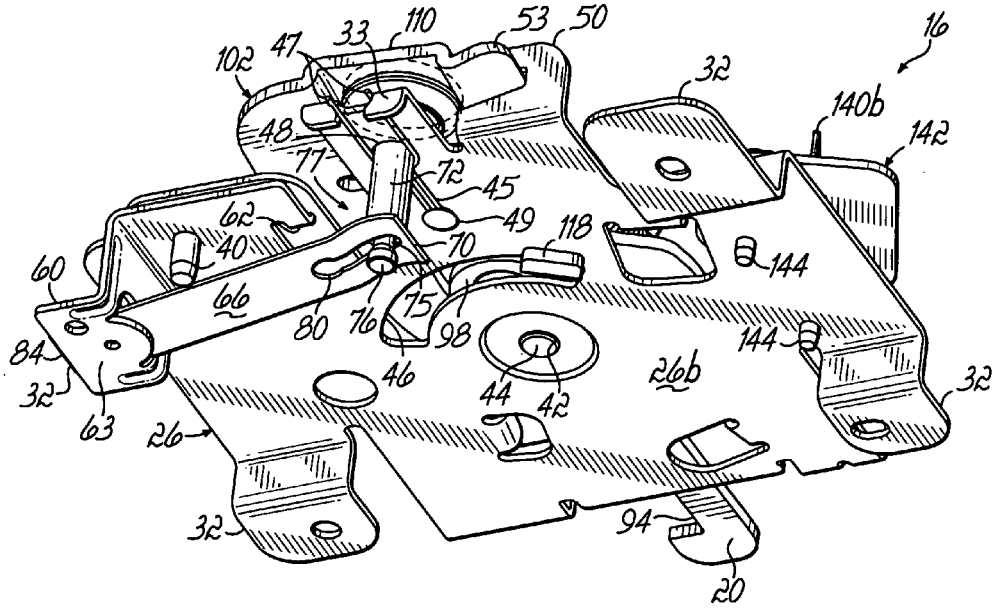
FIG. 2 is a perspective view of the oven door lock embodying principles of the invention in a latched state.
Figure 2A:
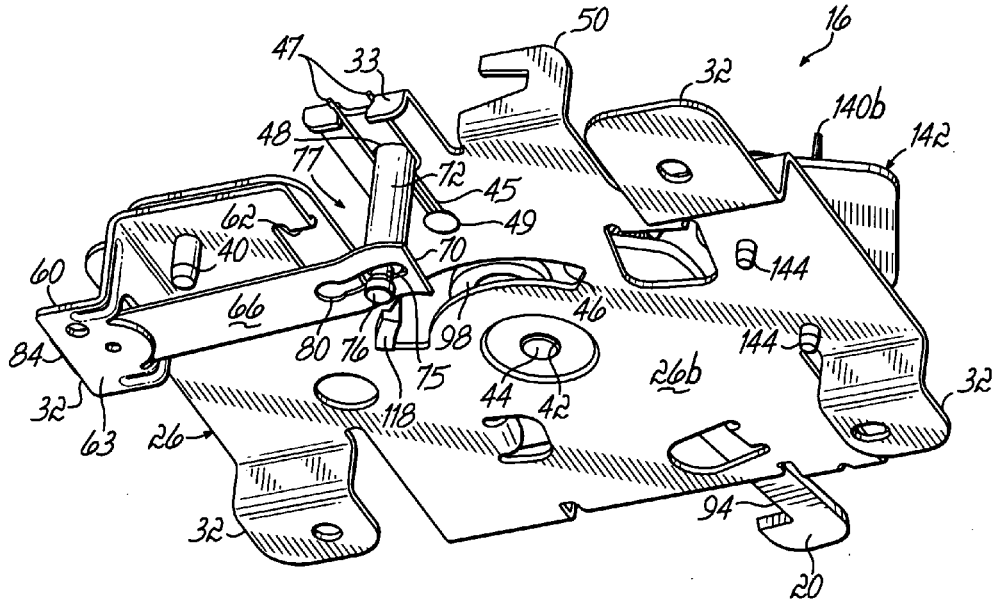
FIG. 2A is a perspective view of the oven door lock embodying principles of the invention in an unlatched state.
Figure 3:
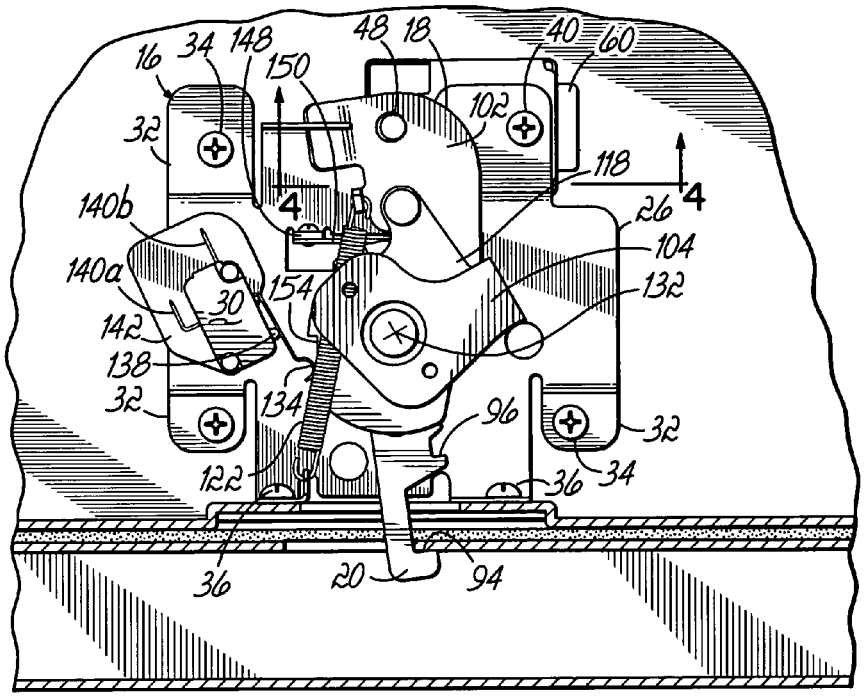
FIG. 3 is a top view of the oven door lock embodying principles of the invention showing operation of the oven door lock.
Figure 4:
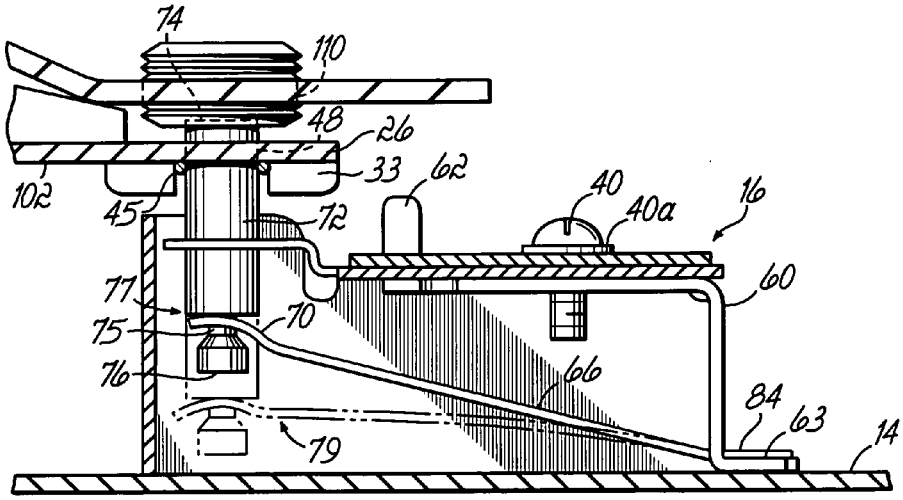
FIG. 4 is a cross-sectional rear view of an oven door embodying principles of the present invention.

Referring to FIGS. 2, 2A and 4, the lock mechanism 78 houses a clutch mechanism 79. Clutch mechanism 79 comprises a first thermally responsive element 66, a clutch 77, and a lock member 72. The first thermally responsive element, such as a bimetallic leaf 66 is attached at its first end 84 to the downwardly depending flange 63 of the mounting foot 60. The first thermally responsive element has a second end 70, which defines a slot 80 which is in engagement with lock member 72.

The principles and an alternate embodiment of the present invention are shown in detail in FIGS. 4, 5, 6 and 7. As seen in the cross sectional view of FIG. 4, the bimetallic leaf 66 is attached to the flange 63 as a cantilever, that is, the second end 70 comprising the slot 80 of the bimetallic leaf 66 is free to deflect in response to heating the bimetallic leaf 66, as discussed further below. A lock member, for instance, lock rod 72, has a first end 74 received through a guide hole 48 defined in the mounting bracket 26. The second end 76 of the lock rod 72 has a keyed aperture 75. This keyed aperture comprises an annular recess, i.e., an internal circumferential groove, with respect to the surface of the lock rod 72 and does not extend to the tip of the second end 76. Recess 75 is designed to be received through slot 80 defined in the bimetallic leaf 66 and is inseparably engaged with the second end 70 of the bimetallic leaf 66. The recess 75 may be of varying length along the axial surface of the lock rod 72 to determine the difference in temperatures at which the oven door locks and unlocks during a self cleaning cycle. The recess 75, acting in concert with the first spring 45 provide the lock and unlock temperature differential capabilities of the present invention as discussed in further detail on pages 16 and 17.

As seen in FIG. 5, slot 80 is a slot of any size, preferably an elongated slot, along the second end 70 of bimetallic leaf 66. Recess 75 defines a first side of clutch 77, and slot 80 defines a second side of clutch 77. Slot 80 is slidably and inseparably in engagement with recess 75, of lock rod 72. Slot 80 has a width slightly larger than the diameter of recess 75, thus allowing slidable engagement. The second end 76 of the lock rod 72, terminal to the recess 75, is larger than slot 80 and thus provides the inseparability between the bimetallic leaf 66 and the lock rod 72. This engagement between slot 80 in the bimetallic leaf 66 and the recess 75 in the lock member 72 defines clutch 77.

As seen in FIG. 2, first end 84 of the bimetallic leaf 66 is affixed to flange 63 of the mounting foot 60 by means of a rivet or any other suitable means. The flange 63 directly contacts the cooking chamber wall 14 when assembled with the cooking apparatus 10. Direct or indirect contact with the flange 63 allows the bimetallic leaf 66 to deflect in response to heating. Indirect contact may be needed where a separate metal piece is used to mount the latch to an oven cavity.

As seen in FIG. 3, the latch mechanism 18 includes the latch arm 20 having a door catch 94 which, when moved from the unlatched to the latched state, when the door 22 (FIG. 1) is closed, will engage the door to maintain it in a closed position during oven self-cleaning. The latch arm 20 also has a safety catch 96, another notch in latch arm 20 immediately adjacent to door catch 94. Safety catch 96 serves to prevent the latch arm 20 from moving to the latched state when the oven door 22 is fully or partially open and in an unlatched state, thereby, preventing the cooking apparatus 10 from entering into a self-cleaning mode while the oven door 22 is unlatched. The latch arm 20 (FIG. 1A) is affixed to the mounting plate 26 with the latch pin 44 received through a bushing 98 journaled in an elongate latch slot 100.

A link arm 102 (FIG. 1A) links the latch arm 20 to a handle mount 104 to allow manual operation of the latch mechanism 18 to move the latch arm 20 from the unlatched state to the latched state. The link arm 102 has a first end 106 pivotally affixed approximately medially to the latch arm 20 with a first link pin 108. The link arm 102 is attached proximate second end 110 to the handle mount 104 with a second link pin 112. The mounting bracket 26 has a flange 50 defining a notch 52 which accurately positions the latch mechanism 18 in alignment with the lock mechanism 78 when the latch mechanism 18 is in the latched state by receiving therein an upwardly angled flange 53 proximate the second end 110 of the link arm 102. The link arm 102 further defines a lock hole 110 for substantial coaxial alignment with the guide hole 48 in a latched-locked state. In a preferred embodiment, the lock hole 110 is fitted with a receiver member 73 adapted to receive a lock member 72 therein. The receiver member 73 may be a bushing, e.g., threaded so as to be screwed into or out of the lock hole 110. The receive member 73 further calibrates or refines the degree of control over the precise temperatures at which the oven door will lock and unlock. If a closer or finer range of control of the temperature at which the oven door locks and unlocks is required, then such a bushing is inserted into the lock hole 110; otherwise it may be omitted for a wider range.

As seen in FIGS. 2 and 2A, the handle mount 104 (FIG. 1A) has an integral limit flange 18 which is received in the arcuate slot 46. The limit flange 118 travels within the arcuate slot 46 and limits movement of the latch mechanism 18 (FIG. 1A) from the latched state to the unlatched state as the limit flange 118 abuts either end of the arcuate slot 46. A handle 120 (FIG. 1) is attached to the handle mount 104 by any suitable means in order to allow a user to move the latch mechanism 18 from the unlatched state to the latched state.

As seen in FIG. 1A, a second spring 122 is attached at a first end 124 to a first finger 126 integral with the mounting bracket 26 and at a second end 128 to a second finger 130 integral with the link arm 102 so as to provide biasing force to maintain the latch mechanism 18 in either the latched state or the unlatched state. When the latch arm 20 is moved from the unlatched state to the latched state, the second spring 122 moves over-center relative to a pivot point 132 which is generally the center of the latch pin 44. The latch mechanism 18 thus remains stable and biased in both the unlatched state and the latched state (see above).

The switch 30 has a switch arm 134 which bears against a cam surface 136 of the handle mount 104. When the latch mechanism 18 is in the unlatched state, the cam surface 136 bears against the switch arm 134 which depresses a button 138, signaling that the door 22 is unlatched. When the latch mechanism 18 is in the latched state, the cam surface 136 allows the switch arm 134 to bias outwardly away from the button 138 which signals to a user and/or oven control that the door 22 is latched. The switch 30 includes electrical leads 140*a*, 140*b* which send a signal indicating when the latch mechanism 18 has successfully been positioned in the latched state. Sandwiched between the switch 30 and the mounting bracket 26 is an insulation pad 142 which provides thermal and electrical insulation between the switch 30 and the mounting bracket 26. The switch 30 and insulation pad 142 are affixed to the mounting bracket 26 with rivets 144 or any other suitable means.

In the illustrated embodiment shown in FIGS. 1A and 3, the door lock 16 includes a nuisance latch 146 to prevent the latch mechanism 18 from being inadvertently moved to the locked and latched state for self-cleaning operation while the cooking apparatus 10 is being used to cook food. The nuisance latch 146 includes an integral flange 148 depending upwardly from the mounting bracket 26 to which a second thermally responsive element, e.g., bimetallic leaf 150, is secured by rivet 152 or any other suitable means. When the cooking apparatus 10 is used for cooking rather than self-cleaning, bimetallic leaf 150 is heated and deflects toward the handle mount 104 and is received within a notch 154 (FIG. 3) defined in the handle mount 104. When received within the notch 154, the bimetallic leaf 150 prevents a user from moving the latch mechanism 18 from the unlatched state to the latched state.

Figure 6:
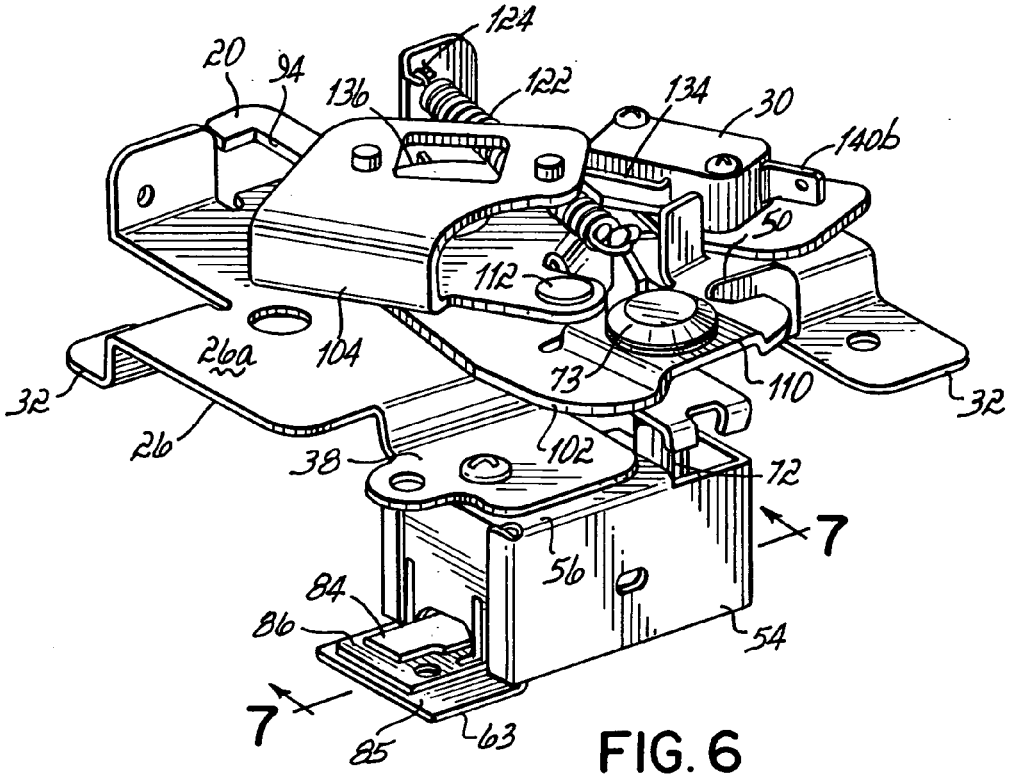
FIG. 6 is a perspective view of an alternate embodiment of the oven door lock as shown in FIG. 2.
Figure 7:
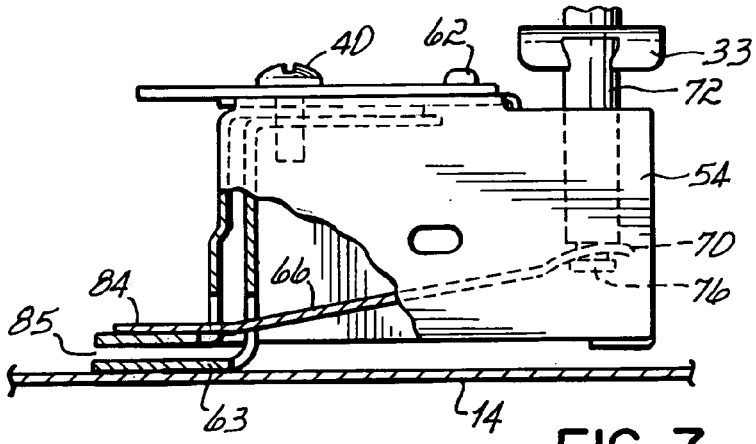
FIG. 7 is a cross sectional view of the oven door lock as shown in FIG. 6.

In an alternate embodiment, as seen in FIGS. 6 and 7, the first end 84 of the bimetallic leaf 66 may be affixed to an isolation foot 86 by means of a rivet or any other suitable means. Isolation foot 86 is affixed by screw 40, to the inside surface 58 of cover 54 of lock mechanism 78. A lock washer may not be necessary to affix isolation foot 86 to cover 54. Bimetallic leaf 66, in this embodiment, is not in direct or indirect contact to the cooking chamber wall 14, but is separated from flange 63 by gap 85. Bimetallic leaf 66 deflects more in response to the temperature of the air in the cooking chamber 17 and less in response to the temperature of the cooking chamber wall 14 than in the prior embodiment.

The self-cleaning operation cannot be started without a connection through switch 30 verifying that the door 22 is closed and latched. If the oven door 22 is unlatched, either in an open or closed position, and an attempt is made to initiate the self-cleaning operation, the self cleaning operation will not initiate. When the oven door 22 is in an unlatched state in a closed position, the second spring 122 of the latch mechanism 18 will maintain the latch arm 20 in its unlatched state. Also, if the door 22 is closed and the cooking apparatus 10 is in use for cooking, the latch mechanism 18 will be prevented from being latched to prevent initiation of the self-cleaning operation and, thus, prevent food being cooked from being locked within the cooking apparatus 10 and, therefore, burning.

When the cooking apparatus 10 is placed in self-cleaning mode or heated to elevated temperatures during normal cooking, the clutch 77 of the clutch mechanism 79 engages to control locking and unlocking temperatures. At the elevated temperature, the bimetallic leaf 66 expands or deflects into engagement with the lock member, preferably a lock rod 72, causing the lock rod 72 to ascend towards the lock hole 110 on the latch mechanism 18. When the lock rod 72 ascends into the lock hole 110, the door 22 is locked closed preventing the latch mechanism 18 from moving to an unlatched state from a latched state. In effect, the oven has achieved a latched-locked state.

When cooking or self-cleaning cycle is complete and the heating source is removed, the oven cavity 17 will cool down and the oven door 22 will unlock. During cool down, as the temperature decreases, the bimetallic leaf 66 contracts and retracts. During retraction, the bimetallic leaf 66 traverses the entire length of the annular recess 75. During traversal, the lock rod 72 remains it its locked state or in the lock hole 110 due to the frictional force exerted upon it by the first spring 45. After traversal, the continual contractile motion of the bimetallic leaf 66 begins to pull the lock rod 72 in the direction of retraction. The retractive force overcomes the counteracting frictional force exerted by the first spring 45 and causes the lock rod 72 to descend and release from the lock hole 110, thus unlocking the oven door 22. The temperature at which the lock rod 72 is released, can be controlled by the length or distance of the annular recess 75 that the bimetallic leaf 66 must traverse before it affirmatively removes the lock rod 72 out of the locking mechanism 78, i.e., out of the lock hole 110. This recess 75 can be calculated to allow unlocking to occur at any desired cooling temperature, based on the expansion and contraction characteristics of the bimetallic leaf 66. It is well known in the art that metals have differing rates of hysteresis and that bi-metals, in particular, have hysteresis between expansion or curling during heating and retraction or uncurling during cooling. The length or distance of the traversed annular recess 75 coupled with the retraction characteristics of the bimetal 66 and the retaining force of the first spring 45 will allow a reduced temperature, substantially lower than that at which the oven locks, at which the lock rod 72 is released from the lock hole 110, to effect the unlocking of the oven door.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, the thermally responsive elements need not be bimetal leaves, but could alternatively be shaped memory effect metals, or others. The invention in its broader aspects is therefore not limited to the specific details, representative apparatus and method, and illustrative example shown and described. Accordingly, it is apparent that certain modifications or alterations can be made without departing from the spirit and scope of the invention set forth in the appended claims.

We claim:

1. An oven door locking mechanism comprising:

a clutch mechanism comprising a thermally responsive element, a clutch, and a lock member; and a first spring in contact with said lock member, wherein said lock member defines a first side of said clutch as a keyed aperture, said keyed aperture is engaged with said thermally responsive element, whereby the oven door locking mechanism locks and unlocks an oven door at substantially different temperatures and wherein said thermally responsive element defines a second side of said clutch as a slot, said slot in engagement with said keyed aperture.

2. The oven door locking mechanism of claim 1, wherein the keyed aperture comprises an annular recess.

3. The oven door locking mechanism of claim 1 wherein said lock member has a first end and a second end, said first end defines said keyed aperture.

4. The oven door locking mechanism of claim 1 wherein said first spring encompasses said lock member.

5. The oven door locking mechanism of claim 1 wherein said slot is elongated.

6. The oven door locking mechanism of claim 1 further comprising:

a latch mechanism defining a lock hole adapted to receive said lock member; and a mounting bracket wherein said first spring is affixed to said mounting bracket.

7. The oven door locking mechanism of claim 1 wherein said thermally responsive element is a bimetallic leaf secured at a first end and defining said slot at a second end.

8. The oven door locking mechanism of claim 6 wherein said lock hole comprises a receiver member.

9. The oven door locking mechanism of claim 8 wherein said receiver member is a bushing.

10. An oven door locking mechanism comprising:

a clutch;

a thermally responsive element defining a second side of said clutch as a slot;

a lock member defining a first side of said clutch as a recess, said recess is engaged with said slot;

a latch mechanism defining a lock hole adapted to receive said lock member at end opposite said recess, said lock hole comprises a bushing; and a mounting bracket comprising a first spring, said first spring encompasses said lock member.

11. An oven door locking mechanism comprising:

a clutch mechanism comprising a thermally responsive element, a clutch, and a lock member;

a first spring in contact with said lock member, wherein said lock member defines a first side of said clutch as a keyed aperture, said keyed aperture is engaged with said thermally responsive element, a latch mechanism defining a lock hole comprising a receiver member adapted to receive said lock member; and a mounting bracket wherein said first spring is affixed to said mounting bracket, whereby the oven door locking mechanism locks and unlocks an oven door at substantially different temperatures.

* * * * *